US005141170A

United States Patent [19]

Sarfati

[11] Patent Number: 5,141,170

[45] Date of Patent: Aug. 25, 1992

[54] FRICTION THREAD FEED DEVICE

[75] Inventor: Alberto G. Sarfati, Como, Italy

[73] Assignee: Sobrevin Société de brevets industriels-Etablissement, Altenbach, Liechtenstein

[21] Appl. No.: 494,728

[22] Filed: Mar. 9, 1990

[30] Foreign Application Priority Data

Mar. 11, 1989 [DE] Fed. Rep. of Germany ..... 3908012

[51] Int. Cl.[5] ..... B65H 51/20

[52] U.S. Cl. ..... 242/47.08

[58] Field of Search ..... 242/47.01, 47.08, 47.09, 242/47.11, 47.12, 47.1; 139/452, 450; 66/125 R, 132 R

[56] References Cited

U.S. PATENT DOCUMENTS

| | | | |
|---|---|---|---|
| 2,471,362 | 5/1949 | Vin | 242/47.09 |
| 2,773,588 | 12/1956 | Downing | 242/47.01 |
| 3,912,184 | 10/1975 | Bous | 242/47.01 |
| 3,945,581 | 3/1976 | Schippers et al. | 242/43.2 |
| 4,047,675 | 9/1977 | Jacobsson | 342/47.01 |
| 4,617,971 | 10/1986 | Hellshoem | 242/47.01 |

FOREIGN PATENT DOCUMENTS

| | | | |
|---|---|---|---|
| 450552 | 11/1947 | Italy | 242/47.11 |
| 1129765 | 10/1968 | United Kingdom . | |

*Primary Examiner*—Stanley N. Gilreath
*Attorney, Agent, or Firm*—Martin A. Farber

[57] ABSTRACT

A friction thread feed device having at least two drums (5, 6) which are arranged spaced apart from each other and are partially wrapped by the thread (F), the drums being driven in the direction of travel of the thread (F) with a circumferential speed which is considerably greater than the thread removal speed. In order to avoid the layers of thread passing onto each other upon multiple wrappings on the drums and also in the case of threads of difficult shape, partitions (17, 18) which divide the drum outer surfaces into individual adjacent regions which are axially offset from each other are fastened in the region of the space between the drums (5, 6 ).

15 Claims, 7 Drawing Sheets

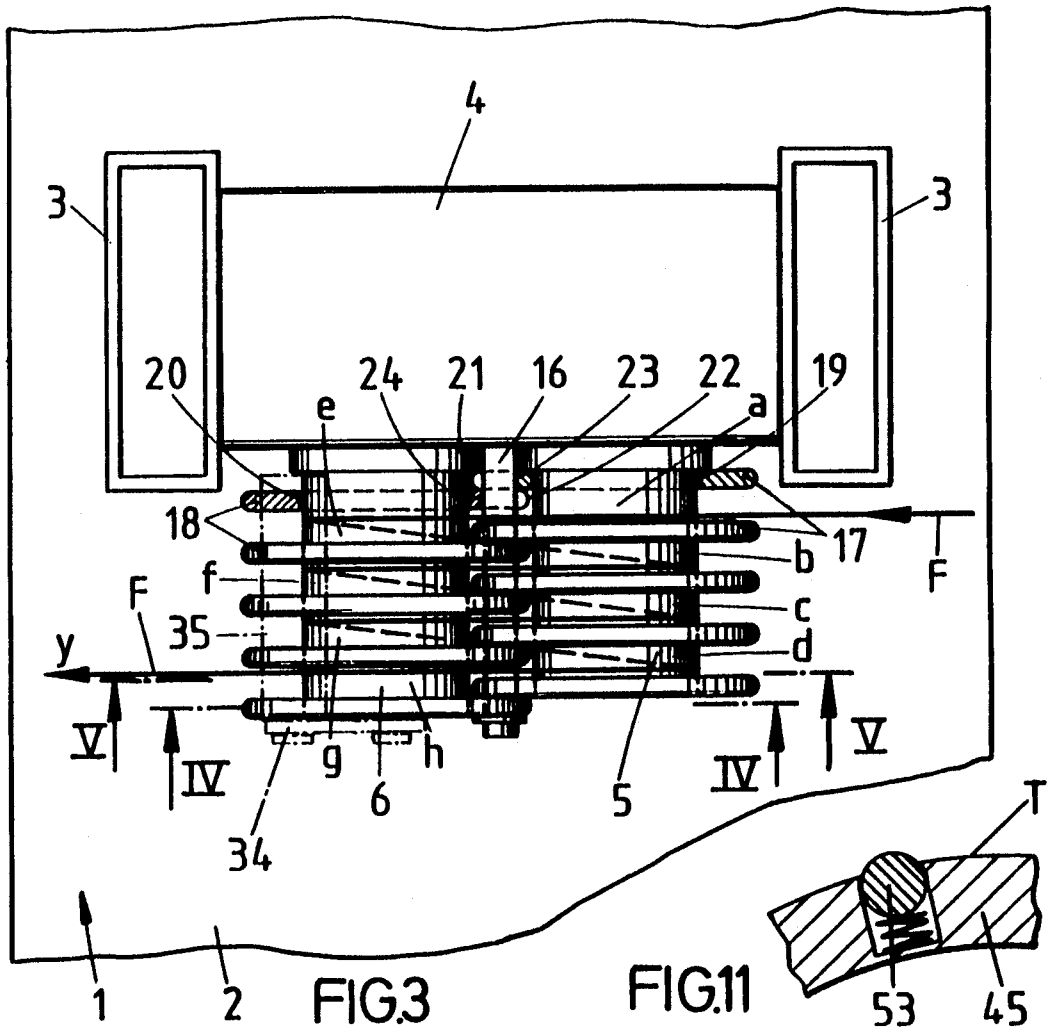
FIG.11
FIG.3
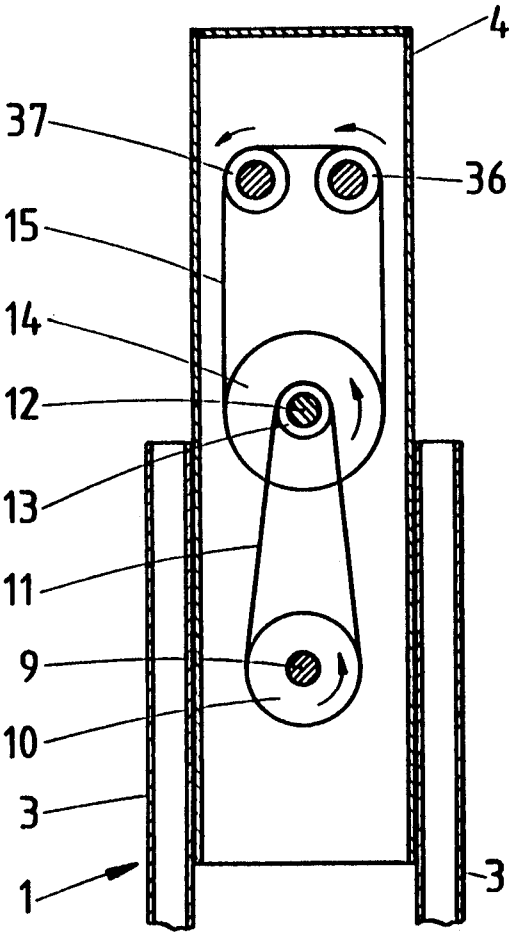
FIG.2

FRICTION THREAD FEED DEVICE

FIELD AND BACKGROUND OF THE INVENTION

The present invention relates to a friction thread feed device having at least two drums which are arranged spaced from each other and partially wrapped by the thread, the drums being driven in the direction of travel of the thread with a circumferential speed which is considerably higher than the thread removal speed.

A friction thread device of this type is known from Federal Republic of Germany 31 25 962 C2 in which the thread coming from a thread storage package wraps around two drums driven in the same direction and arranged parallel to and spaced from each other, in order to pass from there into a storage which is arranged in front of a thread-processing machine. If several wrappings are effected around the two drums, there is the danger that the adjacent thread layer pass into each other. This passage is promoted by the increasing and decreasing tensions of the thread on the drums. If the thread removal tension decreases, then the drums rotate without conveying thread. The thread is then relatively loose.

SUMMARY OF THE INVENTION

The object of the present invention is so to develop a friction thread feed device of this type that even in the case of threads of difficult shape, multiple wrappings around the drums are possible without the danger of thread layers crossing over into each other.

This object of the invention is achieved by partitions which are fastened in the region of a space between the drums and subdivide the drum outer surfaces into individual regions which are offset axially with respect to each other.

As a result of this development, there is created a friction thread feed device of said type which, while being of simple construction, assures optimal conditions of use on the most different types of threads. Despite multiple wrapping of the drums, there is never the problem of adjacent thread layers passing into each other. Disturbances in the removal of the thread are therefore substantially eliminated. In the case of multiple wrapping of the drums, the path of the thread is determined by the partitions which subdivide the outer surfaces of the drums into individual regions which are offset axially from each other. These partitions do not rotate with the drums but are fastened in the spaced region of the drums. Depending on the nature of the thread and the pre-existing thread removal tension, a corresponding number of thread wrappings can be selected. The more often the drums are wrapped, the greater the friction for the same thread removal tension.

The partitions are held on a stationary arm which extends in the space between the adjacent drums and parallel to the axis of them. This also leads to a structurally advantageous embodiment. The formation of the partitions as annular disks makes it simply possible to create a free space for the thread when the latter travels from one partial wrapping of one drum to a partial wrapping of the next drum. If a thread guide roller which is adjacent to the surface of the drum (e.g. FIG. 6) is provided, then the size of the thread partial wrapping angle can be determined by its position. In this connection it is advantageous for this thread guide roller to be adjustable in its position. An infinitely variable change in the circumferential velocity of the drum preferably creates optimal adaptation to the different qualities of thread and, per unit of time, to the withdrawal lengths to be made available.

A certain further adaptation can be obtained by the outer surface of the drums being radiation-roughened and thereupon finished, preferably chromed. This also determines the slipping entrainment between drum outer surface and thread. In order to prevent the thread from jumping over from one drum region to the other, a cover which extends over the drums and partitions is provided as an anti-jump protection for the thread. The crossing of the layers of thread over one another by jumping over the partitions is therefore prevented in an extremely effective manner. Furthermore, measures are taken to prevent excessive heating of a yarn consisting, for instance, of polypropylene or of a corresponding ribbon. For this purpose, the drum wall has a rib-like elevation extending in axial direction on one or more drum sections. As a result of the rapidly rotating drum, there takes place a continuous lifting of the thread which is wrapping around the drum, so that greater heating of the yarn is definitely prevented. A favorable structural form is the development of the rib-like elevation in the form of a bar inserted in the outer wall of the drum. A continuous bar having approximately the length of the drums can be selected, thereby obtaining a particularly simple construction. It is then possible to arrange the bar in such a manner that it is displaceable radially inwardly against spring action. Since the drums pass through the partitions and a slot accordingly remains between them and the drum wall, the size of the slot is so selected that it corresponds at least approximately to the thickness of the yarn. Accordingly, no thread can force its way in there either. The undisturbed operation of the friction thread feed device is not impaired by such a disturbance.

Finally, a time-delayed synchronous connecting of the drum drive to the drive of the corresponding loom is also provided. Upon lengthy standstill of a loom arranged behind the friction thread feed device, a corresponding disconnection of the drive of the drum takes place. Upon starting the loom, on the other hand, first the drum drive is connected.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIG. 2 is a vertical section through the column bearing the rotary drive;

FIG. 3 is a top view of the friction thread feed device;

FIG. 11 is a sectional view broken away in part showing a bar displaceable radially inwardly against spring action.

DETAILED DESCRIPTION OF THE PREFERRED EMBODIMENTS

Figure 1:
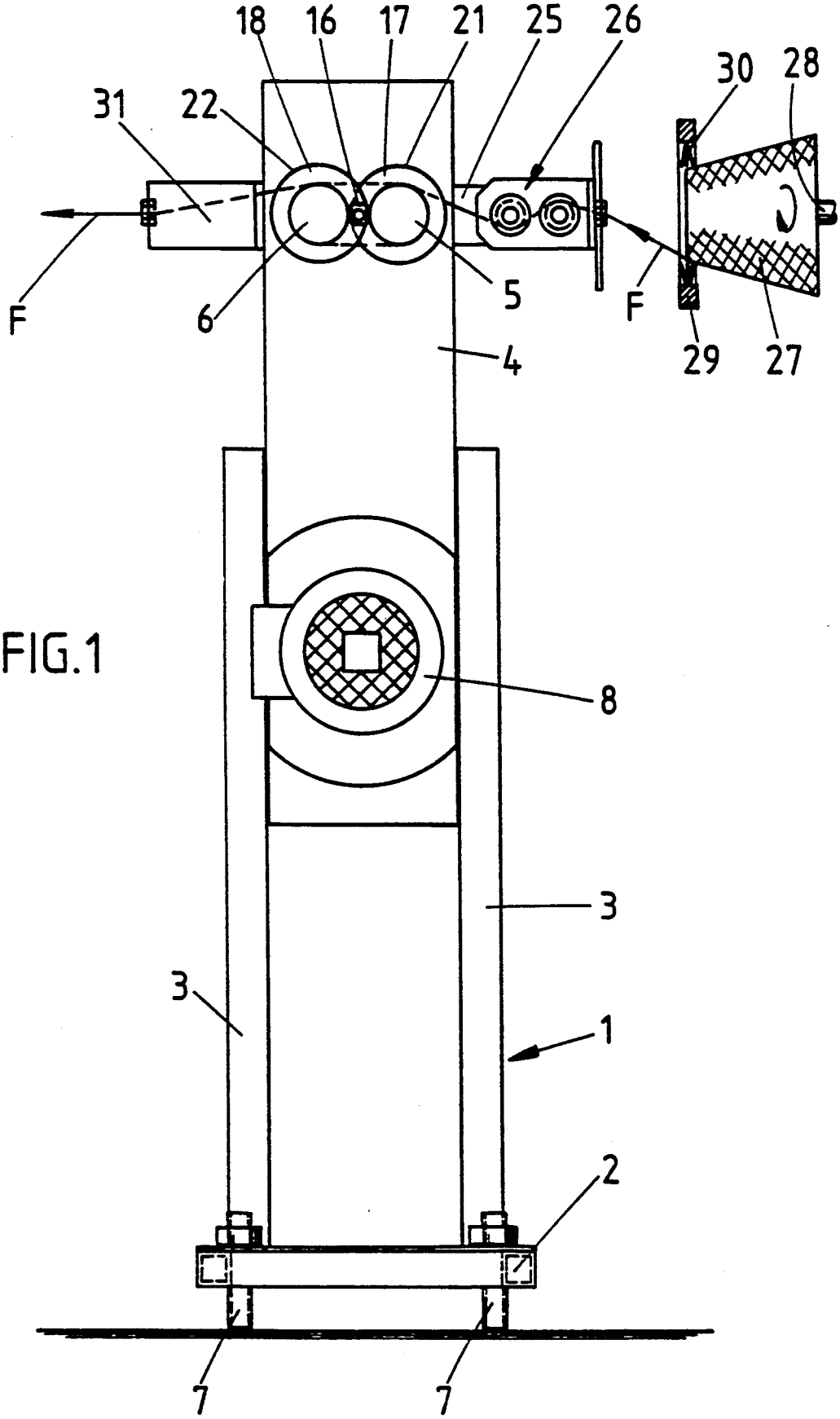
FIG. 1 is a front view of the friction thread feed device in accordance with the first embodiment.
Figure 4:
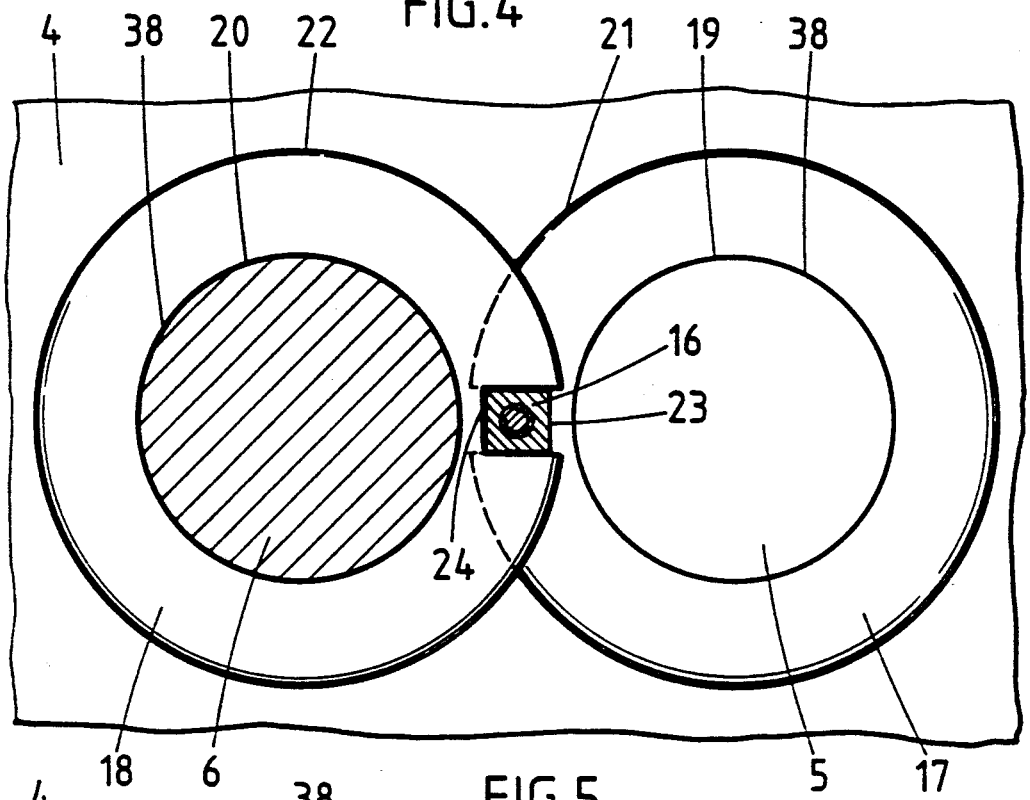
FIG. 4 is a section along the line IV—IV of FIG. 3.
Figure 5:
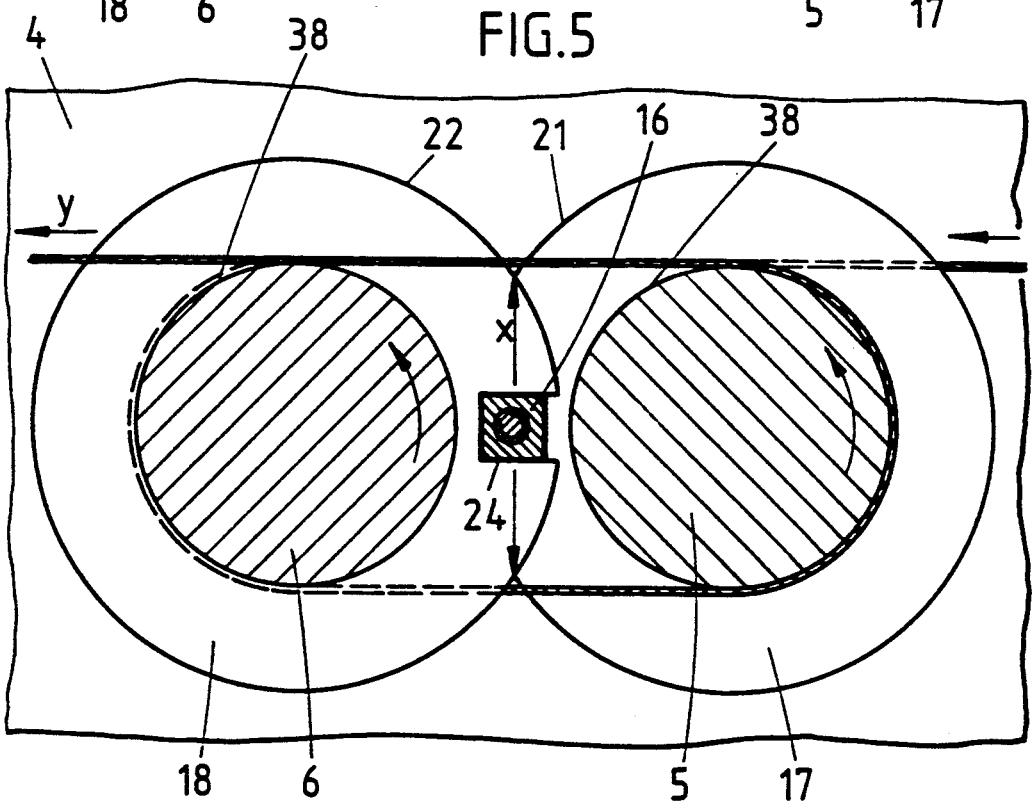
FIG. 5 is a section along the line V—V of FIG. 3.

In accordance with the first embodiment, shown in FIGS. 1 to 5, the friction thread feed device has a machine frame designated generally 1. This frame has a horizontal bed plate 2 and two vertical guides 3 extending from it. Together with a carriage 4 which can be locked in position, they form a vertically adjustable column for drums 5, 6 which are driven in rotation, located on the upper end of the carriage 4. Exact alignment of the column can be effected by means of threaded spindles 7 which pass through the bed plate 2.

In its lower region, the carriage 4 has an electric motor 8 flanged thereon. Its motor shaft 9, which extends into the inside of the carriage, is provided with a drive pulley 10 around which there is a drive belt 11. The belt wraps around a pulley 13 mounted on a pin 12 between drums 5, 6 and electric motor 8 on the carriage. This pulley 13 is preferably integral with an intermediate pulley 14 of larger diameter which also rotates around the pin 12. The belt 15 which is placed around the intermediate pulley 14 drives the drums 5, 6 via pulleys 36, 37. The directions of rotation of the individual pulleys are indicated by arrows in FIG. 2.

The drums 5, 6 are circular-cylindrical bodies which are mounted in cantilevered fashion and the axes of which lie in a common horizontal plane. The drum 5 differs from the drum 6, being of a smaller length.

The carriage 4 is furthermore the support for an arm 16 which extends to the nips of the adjacent drums 5, 6 with its axis parallel to them, namely in the center between the two drum axes. The length of the arm 16 corresponds to the length of the longer drum 6. The arm 16 carries partitions 17 and 18 which are formed as annular disks. The drum 5 extends through the annular disks 17 and the drum 6 extends through the annular disks 18. For this purpose the openings 19, 20 in the partitions 17, 18 correspond to the outside diameters of the drums 5, 6. The annular disks of partitions 17, 18 are so large that their peripheral edges 21 and 22 extend to closely in front of the outer surface 38 of the adjacent drums 5, 6.

Easy mounting of the partitions 17, 18 is made possible by the fact that they have radial cutouts 23, 24, respectively, into which the arm 16 extends in form-fitting manner. Each drum 5, 6 has five partitions 17 and 18 respectively associated with it in such a manner that the partitions 18 overlap the other partitions 17, namely in the manner that each of the drums 5, 6 forms regions a to h located one behind the other for partial wrapping by a thread F. Due to the fact that the partitions 17, 18 are arranged offset from each other, the regions of the drum 5 are also offset with respect to the regions of the other drum 6. The position of the regions is determined by the partitions 17, 18 which are securely mounted on the arm 16. Axial displacement of the annular disks is therefore impossible.

So that, after partial wrapping around one drum the thread F can pass to partially wrap the next drum, the partitions are so dimensioned that the dimension X (cf. FIG. 5) between the points of intersection of the overlapping partitions is less than the diameter of the drums 5, 6.

A thread-brake support 25 is arranged in front of the drum 5. A thread brake 26 of known construction is seated on said support. The thread F passes through the thread brake 26 in the direction indicated by the arrow, the thread F being taken off at its end from a storage package 27. A mount 28 carries the storage package 27. The mount 28 is a carrier pin which is driven in the direction of the arrow opposite the direction of withdrawal of the thread. In the embodiment shown there is a conically tapered storage package 27, the end of which facing the thread brake 26 is surrounded by a brake ring 29. The flexibly developed finger 30 thereof, which faces the outer surface of the storage package 27, counteracts ballooning upon the withdrawal of the thread F.

On the opposite side of the carriage 4 there is also a thread brake 31 which, in its turn, is arranged behind the drum 6. From this thread brake 31 the thread passes to a working station, for instance a loom.

The thread F is fed to the drum 5 in the region a and contacts this region a on the top only in point-like fashion. From the region a the thread passes to the region e of the other drum 6 and wraps around it over about 180°. From the region e the thread passes to the region b of the drum 5. After partially wrapping around this region b, the thread passes to the region f of the drum 6. After partially wrapping around the latter, the thread is deflected to the region c of the drum 5 and from there, after a partial wrapping, to the region g of the drum 6. The thread then, after partial wrapping, comes to the region d of the drum 5, wraps around it, and then travels through the region h of the drum 6 in the direction of removal y. There is thus a zig-zag path of the thread F. The partitions 17, 18 prevent adjacent thread sections from passing onto each other.

During the operation of the friction thread feed device, the drums 5, 6 are driven continuously. As long as no force acts on the other side of the drum 6—seen in the direction of removal—the drums 5, 6 do not effect any removal of the thread from the storage package 27. If the thread coming from the feed device is used, for instance, as filling thread in a loom, then, upon introducing of the filling thread, a force acts on the thread F which brings the thread, by slipping entrainment, to the outer surface of the drums 5, 6 so that the thread F is then withdrawn from the storage package 27. Since the circumferential speed of the drums 5, 6 corresponds to a multiple of the thread removal speed, sufficient thread material is delivered to result in a very low thread removal tension. This may be within the range of 100 to 300 g. The slipping entrainment is also reduced upon a decrease in the thread removal tension.

The drums 5, 6 are driven in the same direction of rotation, as can be noted from the drawings. Furthermore, the pulleys 36, 37 and the drums 5, 6 driven by them have the same diameter so that the drums travel with the same circumferential speed. The drive can be of such a nature that the circumferential speed of the drums is variable.

Corresponding shaping of the surface of the drums assures sufficient slipping entrainment when a thread removal force occurs. For this purpose, the outer surface 38 of the drums 5, 6 can be radiation-roughened and finished, for instance, chromed.

Figure 6:
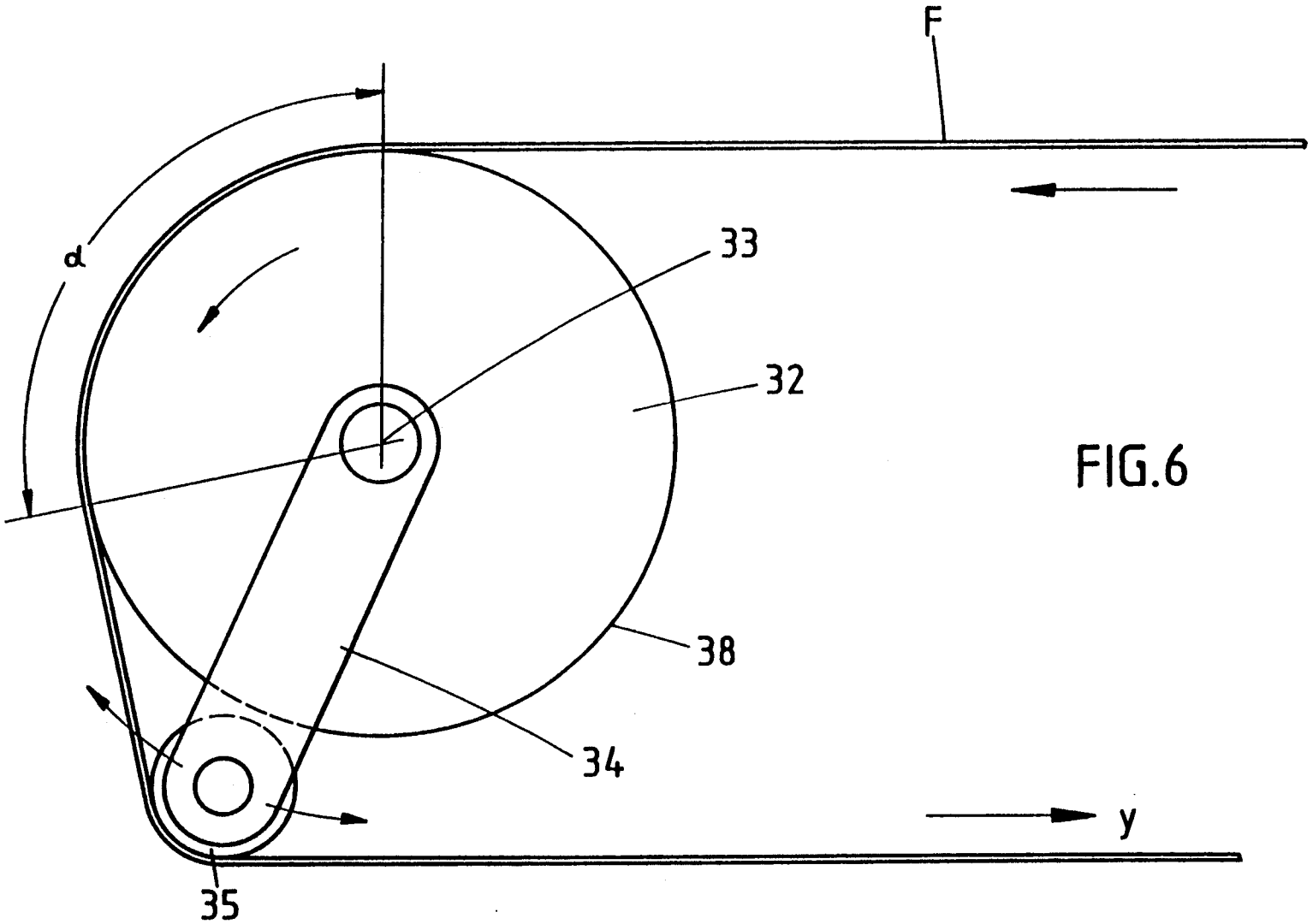
FIG. 6 shows diagrammatically one of the drums cooperating with a thread guide roller in the case of the second embodiment of the friction thread feed device.
Figure 7:
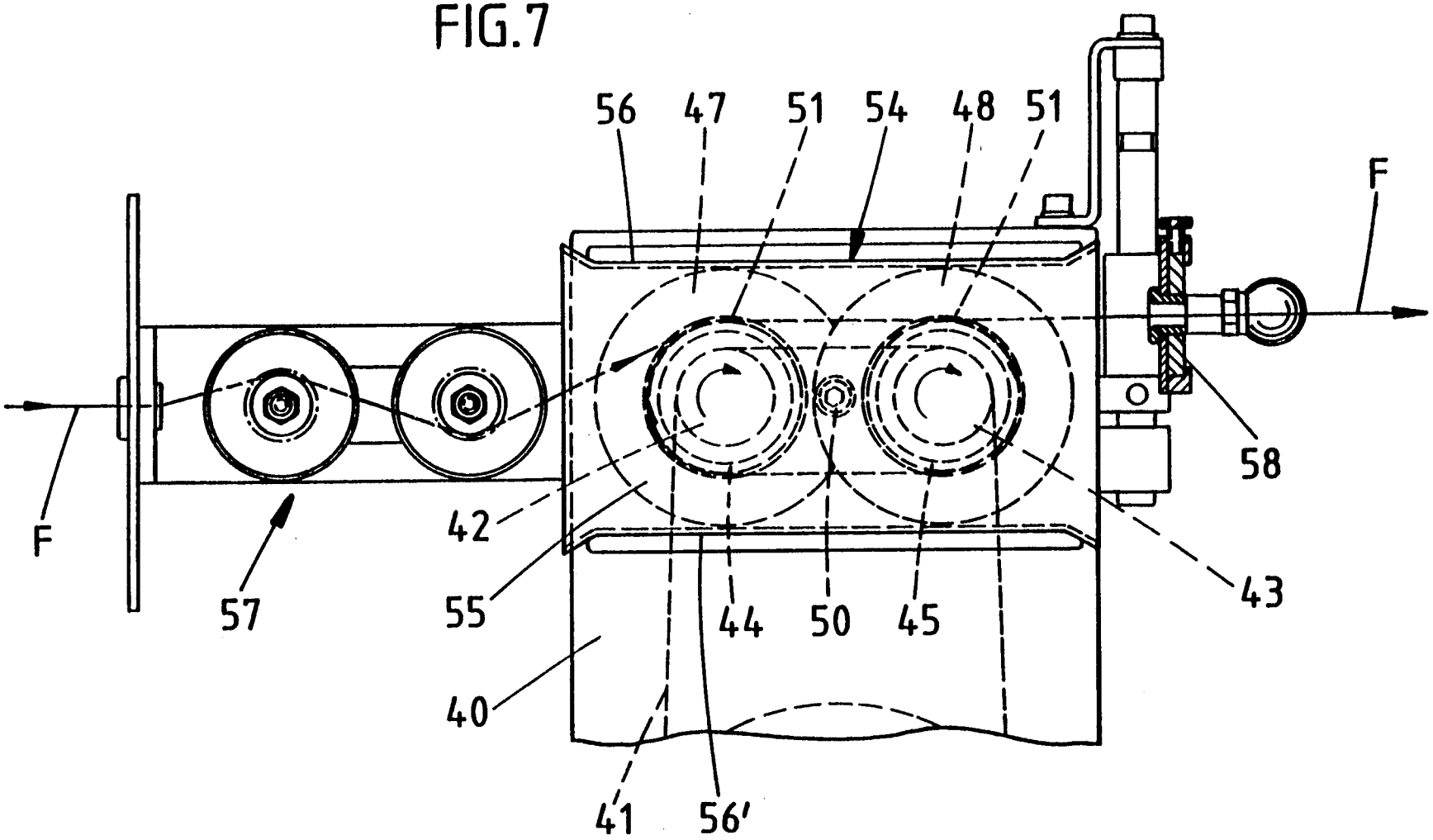
FIG. 7 is a front view partly broken away and partly in section of the friction thread feed device in accordance with the third embodiment.

In the second embodiment, shown in FIG. 6, the drum 32 is driven in the direction shown by the arrow. On the drum shaft 33 there is a pivotally mounted 34 which, on its free end, carries a thread guide roller 35 which is adjacent to the drum outer surface 38. The arm 34 is long enough so that the roller 35 (which is mounted on its end and directed parallel to the axial direction of the drums) extends beyond the partitions 18 when used with the embodiment of FIG. 3 as shown. According to FIG. 3 such a roller 35 is associated with the drum 6 and is shown in an angular relationship to drum 6 similar to that shown in FIG. 6. This showing in FIG. 3 is illustrated in dashed lines and not shown in FIGS. 4 and 5. A corresponding roller is also possible for the drum 5. The position of the arm 34 and thus of the thread guide roller 35 determines the size of the partial wrapping angle of the drum 32. In the embodiment shown, the corresponding partial wrapping angle $\alpha$ is greater than 90°. By displacement of the arm 34 with the thread guide roller 35, this partial wrapping angle can be changed. For this purpose, a displacement device (not shown) can act on the arm 34. By the displacement of the arm 34 in one of the two directions, the slipping entrainment can be varied in simple fashion so that the feed device can be adapted to different grades of thread.

The third embodiment of the friction thread feed device, shown in FIGS. 7 to 10, has a supporting column 40 in which the drum drive (not shown) is arranged. The pulleys 42, 43 are displaced in the same direction of rotation by means of a drive belt 41. The pulleys are firmly attached to drums 44, 45. Here also, these drums are circular-cylindrical bodies mounted in cantilevered fashion, the axes of which lie in a common horizontal plane and are so arranged that the drums are spaced from each other. In contradistinction to the first embodiment, the drums 44, 45 have the same length, i.e., their end, cantilevered edges are flush with each other.

An arm 46 extends in the region of the spacing between the two drums 44, 45, which arm comes from the supporting column 40 and passes parallel to the drums 44, 45, the arm 46 serving to hold partitions 47, 48. The latter are also formed as annular disks, the enclosed openings of which are passed through by the drums 44 and 45 respectively.

In the overlapping regions of the partitions 47, 48 there are bore holes through which the arm 46 extends. Between adjacent partitions 47, 48 there are spacer rings 49. By means of the latter and a screw 50, the partitions 47, 48 are held immovably on the arm 46. In this way, the outer surfaces of the drums are subdivided into individual adjacent regions a' to h' which are offset axially from each other.

The openings provided in the partitions are so selected as to form, between the drum outer wall T and the partitions, a space or slot 51 which at least corresponds approximately to the thickness of the yarn. This space 51 extends concentrically to the drum outer wall T.

The drum outer wall T has a rib-like elevation 52 extending in axial direction on one or more sections of the drum. This elevation is formed in the present embodiment by a bar 53 which is inserted into the drum outer wall T and the circumferential surface of which protrudes beyond the drum outer wall T and forms a protrusion there. The bar 53 is of circular cross section, its length corresponding approximately to that of the drums 44, 45. The bars 53 which form the rib-like elevations 52 protrude to such an extent beyond the drums 44, 45 that they still lie within the space 51 and terminate at a distance in front of the annular openings, so that no thread material can force its way therein either. Instead of a continuous bar, bar lengths which terminate in front of the partitions 47, 48 could also be used.

It would be possible to associate the bars 53 with the drum wall T in such a manner that they are displaceable radially inwardly against spring action (FIG. 11). It need not be particularly emphasized that the outward displacement of the bars must be limited.

Furthermore, a cover 54 which extends over the drums 44, 45 and the partitions 47, 48 is also provided. The cover is of U-shaped cross section. The center arm 55 of the U-shaped profile extends in front of the ends of the drums 44, 45 and the outer partitions 47, 48, while the arms 56, 56' of the U-shaped profile extend up to the outer edges of the partitions 47, 48 and prevents the thread from jumping from one drum region over the partition into the other drum region.

Figure 8:
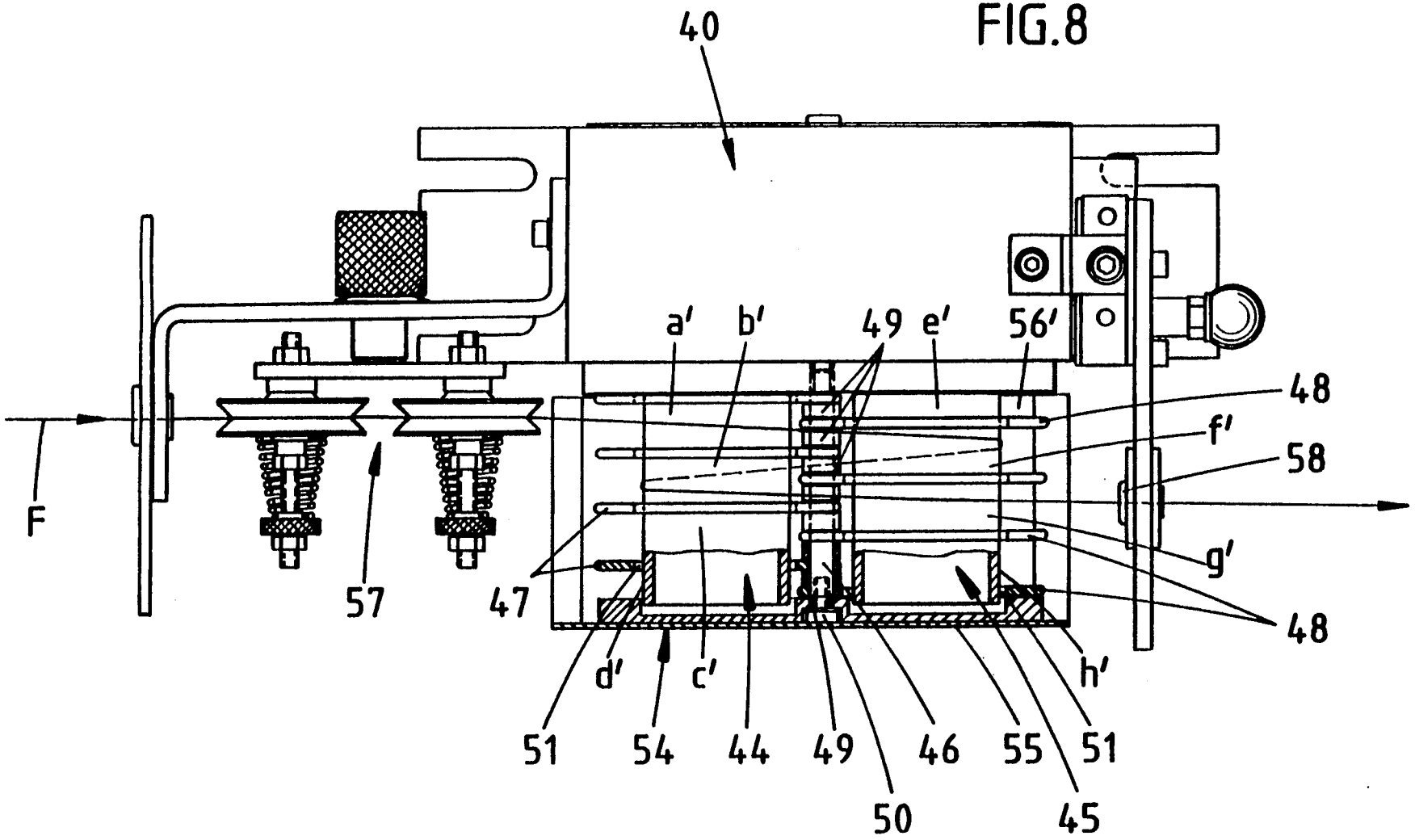
FIG. 8 shows this friction thread feed device partially in top view, partly broken away and partially in longitudinal section.
Figure 9:
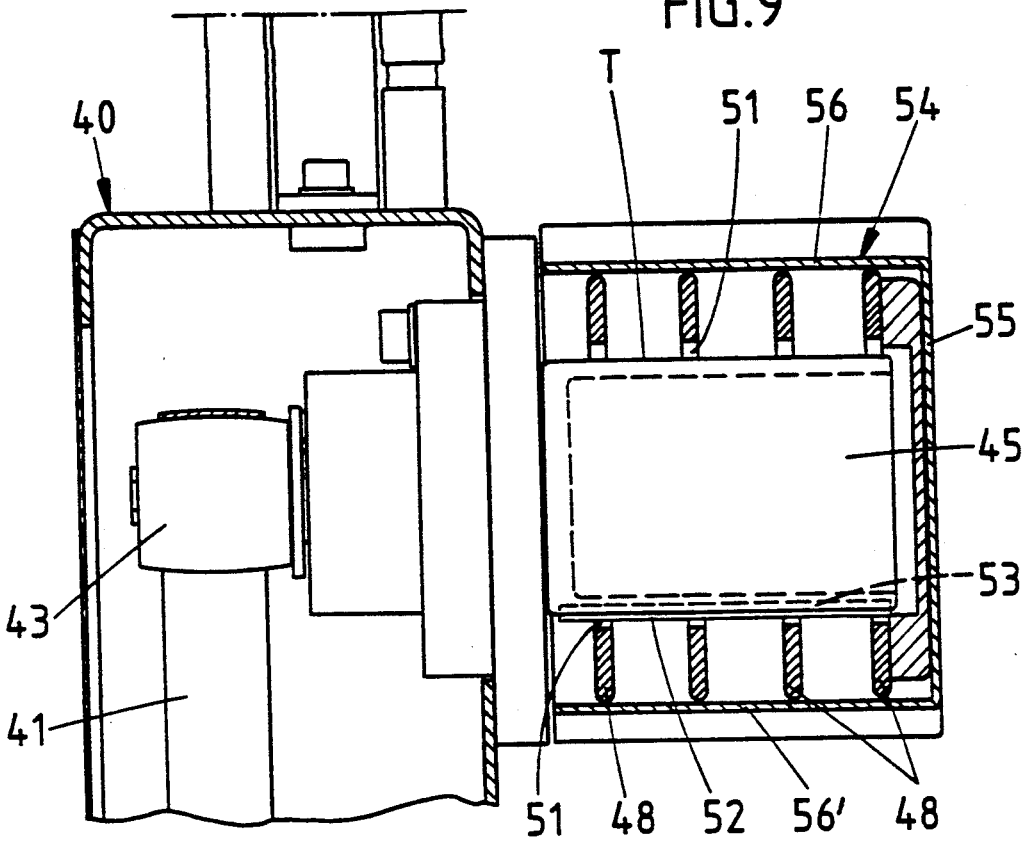
FIG. 9 is a vertical section through the friction thread feed device in the region of a drum.
Figure 10:
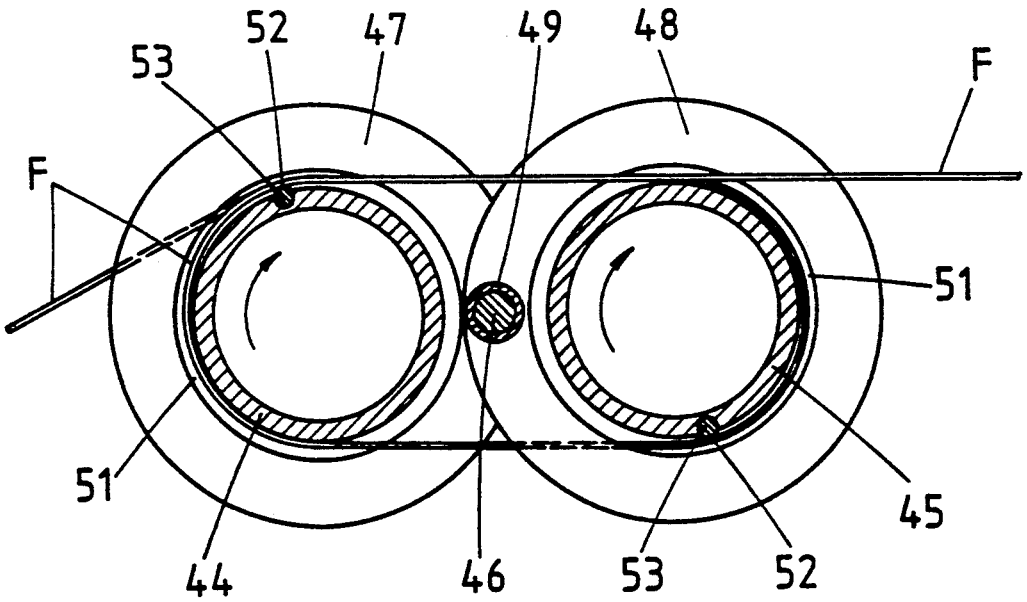
FIG. 10 is a cross section through the drums of the friction thread feed device which are driven in the same direction.

After the removal of the thread F, it passes, in the direction indicated by the arrow, through an adjustable thread brake 57 and then, in the zig-zag path which can be noted from FIG. 8, wraps around the drums 44, 45. After passing over the partial region g', the thread leaves the friction thread feed device through a thread eye 58.

If no removal tension acts on the thread F, there is no slipping entrainment of the thread F. Upon introducing the thread into a loom, controlled for example by water or air, the tension increases, with simultaneous slipping entrainment of the thread. The bar 53 which forms the rib-like elevation 52 continuously lifts the partial wrappings of the thread F during the slipping entrainment, avoiding too great a heating of the thread; see FIG. 10 with respect to this. From this figure, it can be noted that, as a result of the rib-like elevation 52, the thread is lifted off from the drum outer wall in the corresponding region.

A time-delayed synchronized connection of the drum drive to a drive for the driving of the corresponding loom is associated with this friction thread feed device.

I claim:

1. In a friction thread feed device having at least two drums which are spaced apart by a space from each other and partially wrapped by a thread, the drums being driven in a direction of travel of the thread with a circumferential speed which is considerably higher than thread removal speed, the improvement comprising a stationary arm extending in a region of the space between the drums parallel to the axes of the latter, partitions being carried by said stationary arm in the region of the space between the drums and subdividing outer surfaces of the drums respectively into individual regions which individual regions of each drum are offset axially with respect to the individual regions of the other drum, said partitions are annular disks having openings through which said drums extend defining a row of the partitions for each drum with the partitions of each row being arranged in series one behind the other, the annular disks of one row overlapping the annular disks of the other row and extending into gaps which gaps extend between the annular disks of the other row, and the diameter of the drums being greater than a distance between intersection points of overlapping disks of the respective two rows of disks.

2. The friction thread feed device according to claim 1, wherein outer peripheral edges of said partitions of each row at each respective one of the drums extend closely to the outer surface of the other one of the drums respectively.

3. The friction thread feed device according to claim 1, wherein means for varying the circumferential speed of the drums.

4. The friction thread feed device according to claim 1, further comprising a storage package of the thread, and a thread brake is arranged between a first of said drums and said storage package.

5. The friction thread feed device according to claim 1, wherein said outer surfaces of the drums are radiation-roughened and finished.

6. The friction thread feed device according to claim 5, wherein said outer surfaces of the drums are chromed.

7. The friction thread feed device according to claim 1, further comprising a cover extending over said drums and said partitions thereby protecting the thread from jumping over the partitions from one drum surface region into another drum surface region.

8. The friction thread feed device according to claim 1, wherein an outer wall of said drums has an axially extending rib-like elevation on at least one drum section.

9. The friction thread feed device according to claim 8, wherein said rib-like elevation is formed by a bar which is inserted into said outer wall.

10. The friction thread feed device according to claim 1, wherein an outer wall of said drums has an axially extending rib-like elevation on at least one drum section, a spring, said rib-like elevation is formed by a bar which is inserted with said spring into said outer wall, and said bar is disposed in said outer wall so as to be displaceable radially inwardly against spring force of said spring.

11. The friction thread feed device according to claim 1, wherein said openings in the partitions correspond to outside diameters of the drums.

12. The friction thread feed device according to claim 1, further comprising a guide roller, on which the thread engages, is adjacent to at least one of the drum outer surfaces and has positions which determine amount of a partial wrapping angle of the thread on said one drum outer surface.

13. In a friction thread feed device having at least two drums which are spaced by a space from each other and partially wrapped by a thread, the drums being driven in a direction of travel of the thread with a circumferential speed which is considerably higher than thread removal speed, the improvement comprising partitions being fastened in a region of the space between the drums and subdividing outer surfaces of the drums into individual regions which are offset axially from each other, said partitions have openings through which said drums, respectively, extend, and said partitions each have an interior edge defining each of said openings, said interior edges are spaced by an annular slot from the outer walls of said drums, the size of said slot being at least equal to the thread thickness.

14. In a friction thread feed device having at least two drums which are spaced apart by a space from each other and partially wrapped by a thread, the drums being driven in a direction of travel of the thread with a circumferential speed which is considerably higher than thread removal speed, the improvement comprising a stationary arm extending in a region of the space between the drums parallel to the axes of the latter, partitions being carried by said stationary arm in the region of the space between the drums and subdividing outer surfaces of the drums respectively into individual regions which individual regions of each drum are offset axially with respect to the individual regions of the other drum, said partitions are annular disks having openings through which said drums extend defining a row of the partitions for each drum with the partitions of each row being arranged in series one behind the other, the annular disks of one row overlapping the annular disks of the other row and extending into gaps which gaps extend between the annular disks of the other row.

15. The friction thread feed device according to claim 14, wherein outer peripheral edges of said partitions of each row at each respective one of the drums extend closely to the outer surface of the other one of the drums respectively.

* * * * *